United States Patent [19]

Stoll et al.

[11] Patent Number: 4,537,113

[45] Date of Patent: Aug. 27, 1985

[54] BRAKING DEVICE FOR A FLUID POWER ACTUATOR

[76] Inventors: Kurt Stoll, Lenzhalde 72, 7300 Esslingen; Gerhard Hihn, Schurwaldstr. 7, 7300 Esslinge-Berkheim, both of Fed. Rep. of Germany

[21] Appl. No.: 414,681

[22] Filed: Sep. 3, 1982

[30] Foreign Application Priority Data

Sep. 12, 1981 [DE] Fed. Rep. of Germany ..... 3136311

[51] Int. Cl.[3] ..... F15B 15/26

[52] U.S. Cl. ..... 92/24; 92/27

[58] Field of Search ..... 92/24, 26, 27, 28

[56] References Cited

U.S. PATENT DOCUMENTS

| | | | |
|---|---|---|---|
| 3,151,525 | 10/1964 | Dobrikin | 92/24 |
| 3,203,513 | 8/1965 | Allen | 92/26 |
| 3,205,020 | 9/1965 | Schubert | 92/24 |
| 3,397,620 | 8/1968 | Skelton | 92/24 |
| 3,429,233 | 2/1969 | Wright | 92/24 |
| 3,643,765 | 2/1972 | Hanchen | 92/26 |
| 4,185,539 | 1/1980 | Stratienko | 92/24 |

FOREIGN PATENT DOCUMENTS

| | | | |
|---|---|---|---|
| 923412 | 7/1949 | Fed. Rep. of Germany | 92/24 |
| 1958862 | 11/1972 | Fed. Rep. of Germany . | |
| 2164578 | 7/1973 | Fed. Rep. of Germany | 92/26 |
| 2219824 | 10/1973 | Fed. Rep. of Germany . | |
| 2655284 | 6/1978 | Fed. Rep. of Germany . | |
| 2755456 | 6/1979 | Fed. Rep. of Germany . | |
| 1131204 | 2/1957 | France . | |
| 2006340 | 5/1979 | United Kingdom . | |
| 1557141 | 12/1979 | United Kingdom . | |

OTHER PUBLICATIONS

Schiedrum-Hydraulik, Zeitschrift Fluid, Feb. 1974, Kennziffer 42.

*Primary Examiner*—Abraham Hershkovitz

*Attorney, Agent, or Firm*—Flynn, Thiel, Boutell & Tanis

[57] ABSTRACT

A braking device for a fluid power actuator, which braking device automatically brakes the movement of a piston rod in response to a failure in the supply of pressurized fluid to the fluid power actuator. Ball elements are urged radially inwardly between a pair of converging surfaces to cause a drive ring member having a ramp surface thereon to move into engagement with a brake ring to effect a contracting thereof into engagement with the piston rod.

11 Claims, 1 Drawing Figure

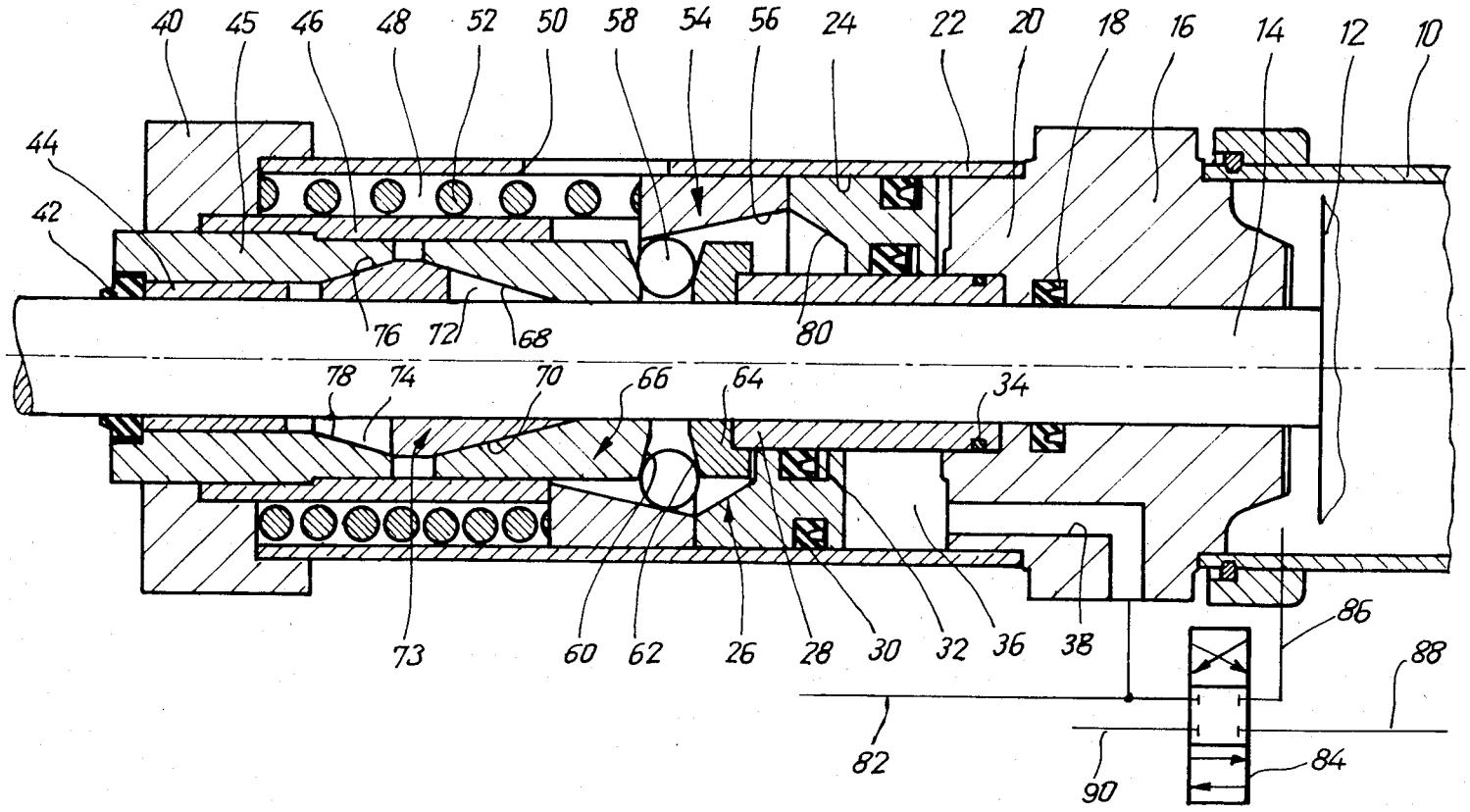
10
12
14
16
18
20
22
24
56
54
58
50
52
48
46
45
40
44
42
80
34
64
66
68
70
72
76
74
78
38
36
32
30
28
26
62
60
73
88
86
84
90
82

BRAKING DEVICE FOR A FLUID POWER ACTUATOR

FIELD OF THE INVENTION

The present invention is with respect to a fluid power actuator with a cylinder and a piston rod, running through one end plate of the cylinder and joined up with a piston within the cylinder and, more particularly, to a braking device therefor responsive to a failure in the supply of pressurized fluid.

BACKGROUND OF THE INVENTION

Such fluid power actuators are presently used in very great numbers in many different sorts of machines as linear driving motors because they take up little space and are troublefree in operation. One shortcoming however is that, more specially in the case of air power actuators, the piston and piston rod are likely to be moved under the effect of outside forces upon the occurrence of an air supply failure. Such uncontrolled motion is more specially undesired if the loads moved by a number of different actuators are to be pushed along a common path and may get in each others way if, because of such a failure, the actuators are no longer timed in the way desired.

SUMMARY OF THE INVENTION

One purpose of the present invention is that of providing a fluid power actuator whose piston rod is automatically braked in position if the fluid power supply is cut off.

A still further purpose of the invention is to make possible such a provision without increasing the radial size of such an actuator.

For effecting such purposes, and further purposes of the invention, a fluid power actuator of the present invention is characterized by the use of a spring-powered brake fixed to the cylinder end wall with the piston rod extending through it, and composed of a brake housing, a brake sleeve supported axially at one end on the brake housing and which has collet fingers thereon whose outer faces are in the form of ramps together forming a common cone, and which, when the brake is not in operation, are rested slippingly against the piston rod. Furthermore the brake has a stiff driving ring, which is coaxial to the brake sleeve and has the piston rod extending therethrough. There is furthermore provided a spring for moving the driving ring towards the brake sleeve, the spring being designed to be acted upon by a brake freeing piston of ring-like form within the brake housing, which may be moved into a brake-freeing position by the ring-like piston placed within the brake housing round the piston rod and walling in a piston space between it and the end plate of the cylinder with the piston rod extending therethrough. The outer faces of the collet fingers are designed for being wedgedly pushed inwards by inwardly facing ramp-like faces in the brake housing and/or the driving ring.

As part of one such further development the brake-freeing piston is designed for sliding on a bushing extending from the side of the piston end wall, the bushing being placed round the piston rod. Such a design makes a wider range of selection of materials for the bushing possible, while on the other hand the brake housing does not have to be very truly lined up with the axis, the bushing not in fact forming a bearing for the piston rod.

As part of a still further development of the invention, the end of the bushing furthest from the cylinder end wall (with the piston rod extending therethrough) has a collar running radially out therefrom, such collar being used as a stop to keep the brake-freeing piston on the bushing.

It is furthermore possible for the brake-freeing piston to have a hollow or pocket in the side thereof facing the collar so as to take up the collar with a certain amount of play, this cutting down the axial size of the spring powered brake.

One further possible development of the invention is such that between the spring and the stiff driving ring there is a step-down ball transmission made up of a ball driver ring having an inner ramp face for driving the balls inwards, which are placed between guiding faces (of which at least one is cone-like) on the collar and the opposite face thereto on the collet driving ring. With such a design the brake sleeve is pushed into its working position by way of the collet driving ring acted upon, by way of the ball transmission, under the effect of the spring. That is to say, collet fingers are moved inwards by way of two step-down transmissions: On the one hand the ramp-like faces on the outsides of the collet fingers and the inside of the collet driving ring, and on the other hand by way of the balls forced inwards by way of the inner ramp face of the ball driving ring so that, on inward motion of the balls, the collet driving ring is pushed along the piston rod in an axial direction. Because of the transmission, of force from the collet driving ring to the collets of the brake sleeve by way of a further ramp-like transmission the force acting on the collets is greatly stepped up and one may be quite certain that the piston rod is strongly gripped if the supply of driving fluid is cut off so that the piston rod is kept quite exactly in the position it had when the fluid was cut off, and will keep to this position even if acted upon by strong outside forces.

As part of a still further development of the invention, the ball-guiding faces, facing each other, on the collar or bushing and the collet driving ring are sloped in opposite directions, this being to make certain that the balls are kept rested against the bushing or collar (which may be taken to be a part thereof) and the collet driving ring with the same contact geometry. This is responsible for a useful effect with respect to cutting down wear of the contacting faces as far as possible and producing the greatest possible axial force component.

As a further development of the invention the collar has play between it and the ball driving ring placed round it, this again decreasing the axial length of the spring force brake.

The brake sleeve may have collets at two sides or ends and not only the collet driving ring but furthermore the brake housing may have ramp faces matching the outer ramps on the collet fingers, this making for a very large braking face on the collets taking effect on the piston rod.

The ramp face for the collets on the housing may be machined on a support sleeve fixed in the end wall of the brake housing furthest from end plates of the actuator cylinder, this making it easier for the ramp face or faces in the brake housing to be produced.

With respect to guiding the collet driving ring a useful effect is produced if the outer face thereof is cylindrical and is designed running in a guide sleeve fixed to the end wall of the brake housing furthest from the actuator.

The spring may be in the form of a helical compression spring placed round the collet driving ring, this being furthermore of help in making the design of the brake as short as possible axially.

DETAILED DESCRIPTION

A detailed account of one working example of the invention will be given using the FIGURE, which is an axial section through part of a compressed air actuator having a spring powered brake designed to take up little space, the brake being viewed in the "on" position in the top part of the FIGURE and in the "off" position in the lower part thereof.

On the right hand side of the FIGURE the reader will see the end of the cylinder 10 of a compressed air actuator together with a small part of the piston 12 running within the cylinder. The left hand end of the cylinder 10 is shut off by an end plate 16 having the piston rod 14 running therethrough to the piston 12. There is a sealing ring 18 for producing a seal between the piston rod 14 and the end plate 16.

The left hand side of the end plate 16 has a cylindrical headpiece 20 of somewhat smaller diameter, on which a cylinder or cylindrical brake housing 22 is fixed in position, for example by the use of adhesive or welding. Housing 22 has a cylindrical inner face 24 with a brake freeing piston 26 running within it and furthermore running on a bushing 28 which is fixed in a hollow on the left hand side of the end plate 16 and has some play between it and the piston rod 14. Brake freeing piston 26 has sealing rings 30 and 32. Furthermore bushing 28 has a gasket ring 34 for producing a seal between it and the end plate 16.

It will be seen from this that there is a cylinder or piston space walled in on the left by the brake freeing piston 26, the inner face 24 of the cylinder 22 and the left hand face of end plate 16, such cylinder space 36 being joined up by way of a hole 38 in the end plate 16 to a compressed air line 82.

The brake housing 22 has at its end to be seen on the left in the FIGURE an end plate 40 which, coaxially in relation to the piston rod 14, has a lip seal 42, a bearing bushing 44, a support sleeve 45 and a guide sleeve 46. In a ring-like spring space 48, placed between the brake housing 22 and the guide sleeve 46, and which is open to the outside air through an opening 50 in the brake housing 22, a helical compression spring 52 is placed, whose left hand end is rested against the right hand end face of end plate 40 while its right hand end is placed up against a ball driving ring 54 running within and on the inner face 24 of the cylinder 22. Ball driving ring 54 has its right hand end face resting against brake freeing piston 26, the same for this reason being resiliently urged to the right in the FIGURE.

Ball driving ring 54 has a cone-like inner space 56 becoming wider coaxially to the right and having a number of transmission balls 58 resting against it which may be moved radially between two ramp or guiding faces 60 and 62, one such face being the free left hand face at the end of a collar 64 which is fixed on the free end of bushing 28, while the other guiding face is the end face of a collet driving ring 66.

Collet driving ring 66 has its right hand end part placed round the piston rod 14 with a small amount of play therebetween while the outer face of ring 66 is sized for running on the inner face of guide sleeve 46.

In the part of the system to be seen on the left in the FIGURE, the collet driving ring 66 will be seen to have an inner space 68 becoming conically wider to the left, and designed for running on matching, outer faces 70 of collet fingers 72 which are resiliently urged outwards and are part of a brake ring 73 or sleeve, which at its opposite end has a second group of collet fingers 74 which are out of line with the first-noted collet fingers. Such left hand collet fingers 74 have outwardly facing ramp faces 76 whose common cone-like face becomes smaller in diameter to the left and is designed for running in a matching cone-like hole 78 within the end part of support sleeve 45.

The brake freeing piston 26 has a frusto-conical hollow or pocket 80 on its left hand side to take up the collar 64 in the braking position.

In the condition ready for operation the compressed air hole 38 is joined up with a compressed air line 82, which, by way of a fourway, 3-connection valve 84 may be joined up as desired with two lines 86 and 88 running to the two working spaces of the actuator. Furthermore, the working spaces may be joined up by way of control valve 86, 88 with a line 90 opening into the atmosphere.

OPERATION

An account will now be given of the operation of the spring powered brake acting on the piston rod in the actuator.

If the compressed air line 82 is at working pressure, the force produced by brake freeing piston 26 will be greater than the force produced by the helical compression spring 52 so that the brake freeing piston 26 will have the effect of moving the ball driving ring 54 to the left in the FIGURE till its left hand end face comes up against the free end face of guide sleeve 46, the transmission balls 58 now touching the part, to be seen on the right in the FIGURE, of the cone hole 56 in ring 54, that is to say the balls are now in their outermost position radially. Because of this, the collet driving ring 66 may be moved to the right so that there is no transmission force at the two faces 68, 70 on the one hand and 76, 78 on the other hand. For this reason the collet fingers 72, 74 on brake sleeve 73 are let back somewhat and may be pulled clear of the piston rod 14 or rested against it so that it may be moved in and out of the actuator.

In the case of a dropout or failure in the compressed air supply, on the other hand, ball driving ring 54 will be moved by coiled compression spring 52 to the right in the FIGURE, so that the brake freeing piston 26 is moved as well. Because the transmission balls 58 are kept in position between the ball guiding faces 60 and 62 this motion of the ball driving ring 54 is responsible for a radially inward motion of the transmission balls 58 which take effect on the ramp-like ball guiding faces 60 and 62 with the outcome that the collet driving ring 66 is moved axially. The motion of the helical compression spring 52 for this reason has to go through two inclined plane transmissions with a step down effect before getting to the collet driving ring 66. The axial motion of the collet driving ring 66 is responsible, by way of the two touching faces 68 and 70 and in the other case 76 and 78, for very large radial forces which come into play on collet fingers 72 and 74 whose inner faces are pressed strongly and powerfully against the piston rod 14, the same being automatically and strongly braked on a dropout in the compressed air supply.

Changes may be made in the brake unit, as for example by causing the brake sleeve 73 (and not the ring 66) to be moved by balls 58.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A braking device for a fluid power actuator, comprising:

an elongate cylinder housing having at least one end wall with an opening extending axially therethrough;

a piston reciprocally mounted in said cylinder housing and having a piston rod extending through said opening;

an elongate brake housing fixedly connected to said cylinder housing with said piston rod extending into said brake housing;

a contractible brake ring mounted in said brake housing and encircling said piston rod and adapted to contract into braking engagment with said piston rod, said brake ring having at least one first inclined ramp surface thereon;

drive ring means mounted on said brake housing, said drive ring means having a second inclined ramp surface thereon conformed to the inclination of and adapted to engage said first ramp surface, said brake ring contracting into braking engagement with said piston rod in response to said first and second ramp surfaces moving into engagement with each other;

guide means on said brake housing for guiding said drive ring means for reciprocal movement to thereby facilitate a movement of said first and second ramp surfaces into engagement with each other;

collar means fixedly mounted on said brake housing and encircling said piston rod and being axially spaced from said drive ring means on a side thereof remote from said brake ring;

means defining radially inwardly converging surfaces on the mutually facing ends of said drive ring means and said collar means;

plural ball elements received between and engaging said converging surfaces, a radially inward movement of said balls effecting an axial movement of said driving ring means and said ramp surface thereon into engagement with said ramp surface on the brake ring;

reciprocal brake freeing piston means mounted on said brake housing and having a third inclined ramp surface engaging said plural ball elements, a movement of said brake freeing piston in a first direction effecting a radially inward movement of said plural ball elements;

resilient means for continually urging said brake freeing piston means in said first direction; and means for urging said brake freeing piston means in a second direction opposite said first direction and against the urging of said resilient means in response to a supply of pressurized fluid, whereby a failure of said supply of pressurized fluid will automatically cause said resilient means to bring said first and second ramp surfaces into engagement and a contracting of said brake ring into braking relation with said piston rod.

2. A braking device according to claim 1, wherein said collar means is supported on a sleeve extending through an opening in said brake freeing piston means and is connected to said one end wall on said cylinder housing.

3. A braking device according to claim 2, wherein said brake freeing piston means includes an actuating piston and a ball driving ring separate from said actuating piston, said ball driving ring having said third ramp surface thereon, a surface on said actuator piston facing said ball driving ring having a recess therein to accommodate the receipt therein of said collar means.

4. A braking device according to claim 3, wherein said ball driving ring has a surface facing said actuator piston with a recess therein to accommodate the receipt therein of said collar means.

5. A braking device according to one of claims 1 to 3, wherein said converging surfaces are equally oppositely inclined to a plane perpendicular to the longitudinal axis of said piston rod.

6. A braking device according to claim 1, wherein said guide means guides said drive ring means for reciprocal movement, wherein said brake ring is provided with a further ramp surface on a side thereof opposite said first ramp surface, wherein a support sleeve is provided on said brake housing and has a still further ramp surface conformed to the inclination of and adapted to engage said further ramp surface in response to an engagement of said first and second ramp surfaces.

7. A braking device according to claim 6, wherein said support sleeve is fixed to said brake housing.

8. A braking device according to claim 6, wherein said drive ring means has a cylindrically formed outer surface and is reciprocally guided in a cylindrical opening in said guide means, said guide means being fixedly supported on said brake housing.

9. A brake device according to claim 8, wherein said resilient means is a compression spring which without contact coaxially encircles said drive ring means.

10. A brake device according to claim 6, wherein said brake ring includes plural first collet fingers contractible into engagement with said piston rod and plural second collet fingers contractible into engagement with said piston rod, all of said collet fingers being contractible in response to a simultaneous engagement of said first and second ramp surfaces and said further and still further ramp surfaces.

11. A brake device according to claim 1, wherein said brake ring includes plural collet fingers contractible into engagement with said piston rod in response to an engagement of said first and second ramp surfaces.

* * * * *